US005192853A

United States Patent [19]

Yeh

[11] Patent Number: 5,192,853

[45] Date of Patent: Mar. 9, 1993

[54] HEATING SET HAVING POSITIVE TEMPERATUE COEFFICIENT THERMISTOR ELEMENTS ADHESIVELY CONNECTED TO HEAT RADIATOR DEVICES

[76] Inventor: Yuan-Chang Yeh, No. 101, 223 Alley, Sec. 1, Tay Pyng Rd., Tsao Twen, Nan Tour, Taiwan

[21] Appl. No.: 780,504

[22] Filed: Oct. 22, 1991

[51] Int. Cl.[5] ..... H05B 3/14; H01C 7/02; F24H 3/04

[52] U.S. Cl. ..... 219/540; 219/505; 219/530; 219/541; 392/347; 392/360; 392/365; 392/379; 338/22 R

[58] Field of Search ..... 392/379, 347, 365, 360; 219/504, 505, 530, 540, 553, 541; 338/22 R

[56] References Cited

U.S. PATENT DOCUMENTS 4,414,052 11/1983 Habata et al. ..... 219/540 X
4,963,716 10/1990 Van der Elst et al. ..... 219/540 X

FOREIGN PATENT DOCUMENTS 2-126586 5/1990 Japan ..... 219/540

*Primary Examiner*—Anthony Bartis
*Attorney, Agent, or Firm*—Browdy and Neimark

[57] ABSTRACT

A heating set having a plurality of positive temperature coefficient thermistor heating elements (PTCR pieces) sandwiched between two heat radiating devices made of metal with each of the PTCR pieces provided with sprayed-on electrodes having their exposed surfaces making close contact with long metal battens on the outer surfaces of the heat radiating devices through conducting thin metal pieces having predetermined surface areas. The PCTR pieces and the heat radiating devices making electrical contact through the thin metal pieces are bonded together by an electrically nonconductive adhesive spread on the border of the battens around the thin metal plate and on opposite parallel edges on the border of the sprayed-on electrodes of the PTCR pieces.

3 Claims, 3 Drawing Sheets

HEATING SET HAVING POSITIVE TEMPERATUE COEFFICIENT THERMISTOR ELEMENTS ADHESIVELY CONNECTED TO HEAT RADIATOR DEVICES

BACKGROUND OF THE INVENTION

The present invention relates to the heating means of a heating assembly and more particularly to a positive-temperature coefficient (abbreviated as "PTC" in this specification) thermistor device which has a high and stable thermal output and is capable of self controlling the temperature.

The PTC thermistor heating element (abbreviated as "PTCR" in this specification) has been widely used as an ideal heat source capable of providing a constant temperature in view of the facts that it has a unique characteristic of "self-temperature-control action" and that it does not react with the oxygen in the air to bring about combustion and further that it neither overheats nor generates a gas polluting the air. The equation of the steady state power output of a PTCR can be written as follows:

$$P=D(T-Ta)$$

in which

D=heat radiating coefficient of PTCR (W/°K.)

T=surface temperature of PTCR (°C.)

Ta=surrounding temperature (°C.)

Upon being in an excited state, the PTCR has a surface temperature slightly higher than the curie point. In addition, the change in the surface temperature of PTCR is limited when an increase in the voltage is made available. Accordingly, an increase in the heat radiating coefficient D is required if an increase in the power output P is called for. For this purpose, the heat radiating means made of metal or alloy is attached to the PTCR electrode so as to permit the heat radiating coefficient D to expand. However, such technology of attaching a heat radiating means made of metal to PTCR has several limitations, which are further expounded explicitly hereinafter.

In order to expand the heat radiating coefficient D, the connecting surfaces of the heat radiating means made of metal and the PTCR electrode must be intimately coupled. In certain models of heating sets having PTCR, the heat radiating means are arranged in such a manner that they urge against the PTCR electrodes by means of biasing springs. Such heating sets are defective in that the biasing springs are subjected to thermal fatigue under high temperature, thereby resulting in a reduction in biasing force. Other models of heating sets having PTCR are designed in such a way that the metal heat radiating means are coupled with PTCR electrodes by means of an electrically conductive adhesive. Such method can effectively increase the heat radiating coefficient D but the adhesive used to connect the heat radiating means and the PTCR electrode is expensive. In addition, the association of heat radiating means with the PTCR electrode by means of such adhesive is vulnerable to collapse upon a mechanical collision or impact. A short circuit can take place when the adhesive is dripped out or squeezed out to bridge the heat radiating means and the PTCR electrode. Furthermore, such adhesive contains silver flakes, which may happen to be distributed unevenly in the adhesive. Such uneven distribution of silver flakes in the adhesive is a safety hazard because it often brings about a gap discharge and sparks. Some recent models of heating sets having PTCR are designed in such a way that the contact surface of the PTCR electrode is corrugated. In other words, the ridges of such corrugated surface of the PTCR electrode are coupled with the surface of the heat radiating means while the grooves of the corrugated surface of the PTCR electrode are filled with the electrically non-conductive adhesive, which serves to bind together the heat radiating means and the PTCR electrode. This method is also defective in that the product rejection rate of the ceramic PTCR having a corrugated surface is relatively high and that the unit contact area between the heat radiating means and the PTCR electrode is too limited to expand the heat radiating coefficient D. It must be noted here that the process of sintering a ceramic PTCR having uniformly a corrugated contact surface is often costly and time-consuming nightmare.

SUMMARY OF THE INVENTION

It is therefore the primary objective of the present invention to provide a PTC heating set with means capable of generating a safe, high, and stable heat output.

It is another objective of the present invention to provide a PTC heating set with means capable of connecting intimately the contact surfaces of the PTCR electrode and the heat radiating means without using a biasing means.

It is still another objective of the present invention to provide a PTC heating set with adhesive bonding means capable of increasing the unit contact area between the PTCR electrode and the heat radiating means. In addition, the adhesive so used is an electrically nonconductive. However, a thin layer of electrically conductive piece is sandwiched between the contact surfaces of the PTCR electrode and the heat radiating means so as to ensure that electrical conduction takes place therebetween in a satisfactory manner.

In keeping with the principles of the present invention, the primary objectives of the present invention are accomplished by a PTC heating set comprising a PTCR and a heat radiating device made of metal and characterizing in that an electrically conductive thin piece having a predetermined surface area and a predetermined thickness is sandwiched between the PTCR and the heat radiating device in such a manner that it makes contact directly with the adjacent surfaces of both the electrode of the PTCR and heat radiating device so as to permit the electrical current to flow from the PTCR electrode to the heat radiating device without interference of electrical nonconductive adhesive portions, thereby resulting in a meaningful expansion of heat radiating coefficient without the incidents of thermal fatigue, short circuit, gap discharge, and sparks. In addition, the PTC heating set of the present invention is further characterized in that the contact surfaces of the PTCR and the heat radiating device are bonded intimately by means of an electrically non-conductive adhesive.

The foregoing features, objectives, and advantages of the present invention will be better understood by studying the following detailed description of the preferred embodiment, in conjunction with the drawings provided herewith.

DETAILED DESCRIPTION OF THE PREFERRED EMBODIMENT

Figure 1:
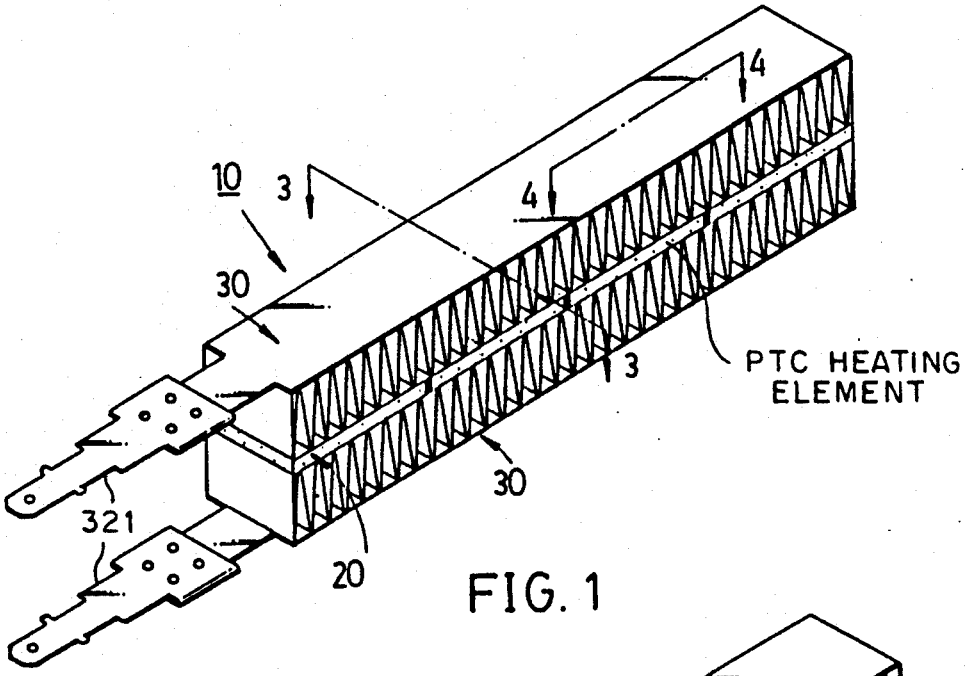
FIG. 1 shows a three-dimensional view of the preferred embodiment of the present invention.
Figure 2:
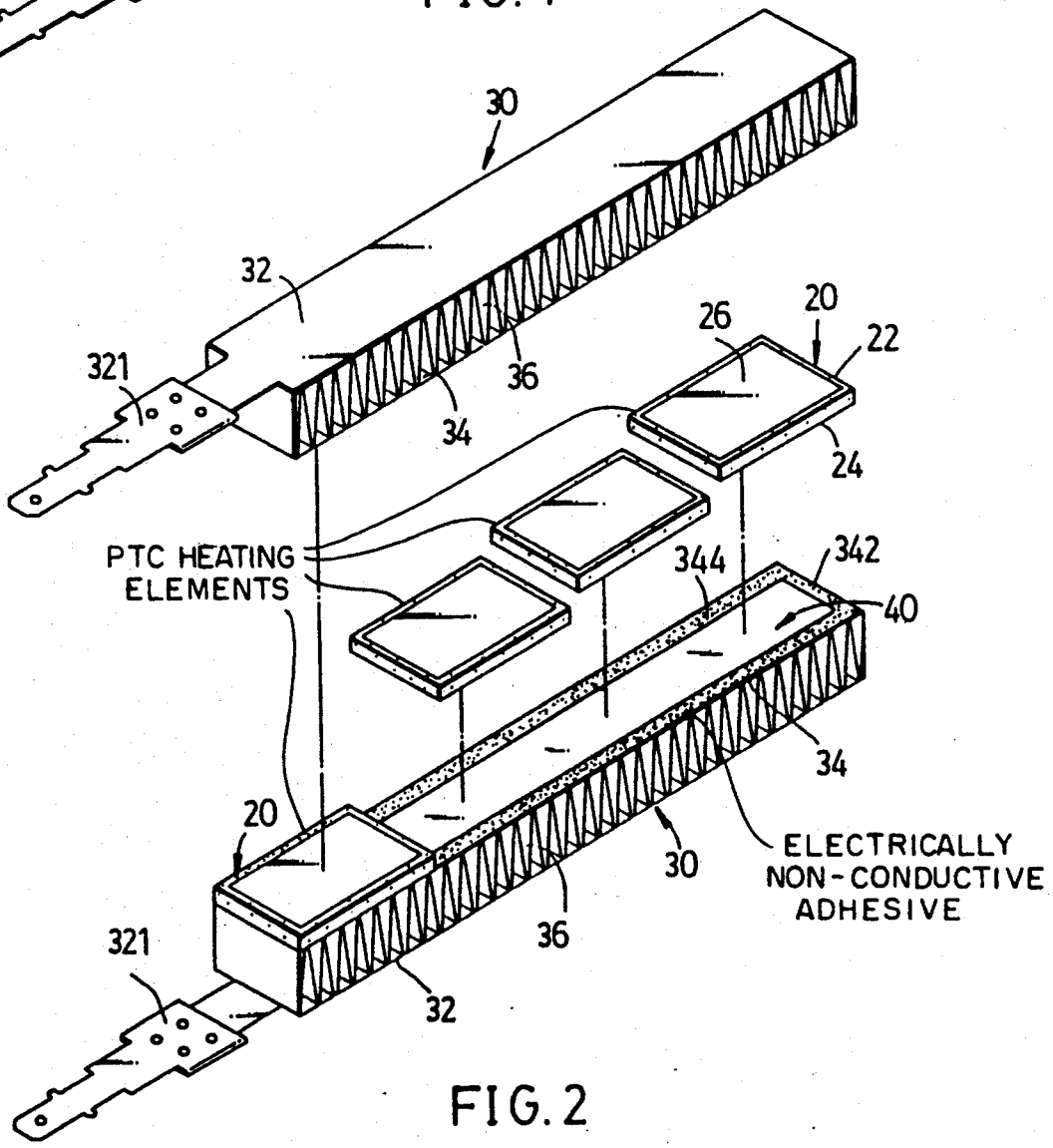
FIG. 2 shows an exploded view of the preferred embodiment of the present invention.
Figure 3A:
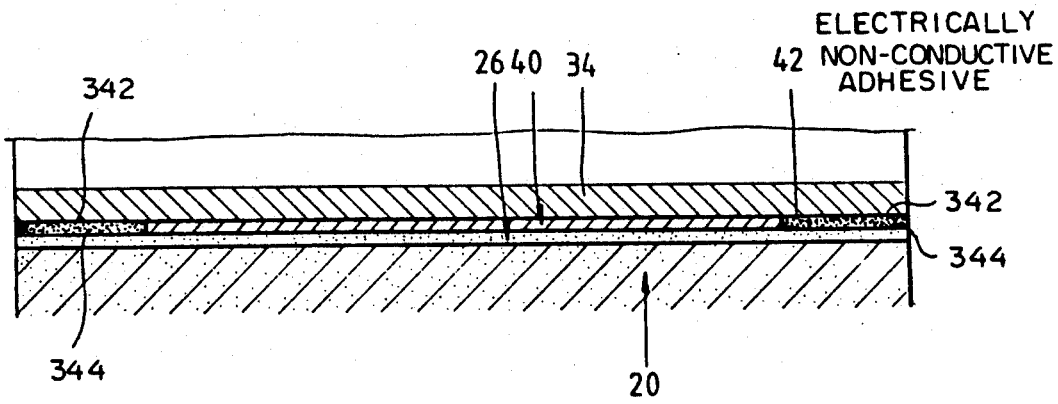
FIG. 3A shows a further enlarged view of a portion of FIG. 3.
Figure 4B:
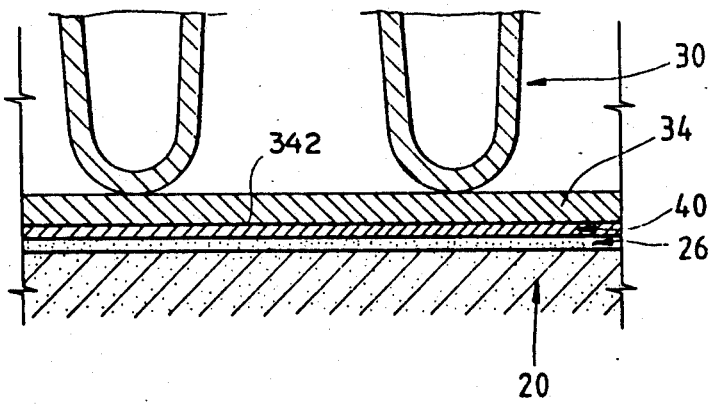
FIG. 4 shows a sectional view of the portion taken along the line 4—4 as shown in FIG. 1.
FIG. 4A shows a further enlarged view of a portion of FIG. 4.
Figure 3:
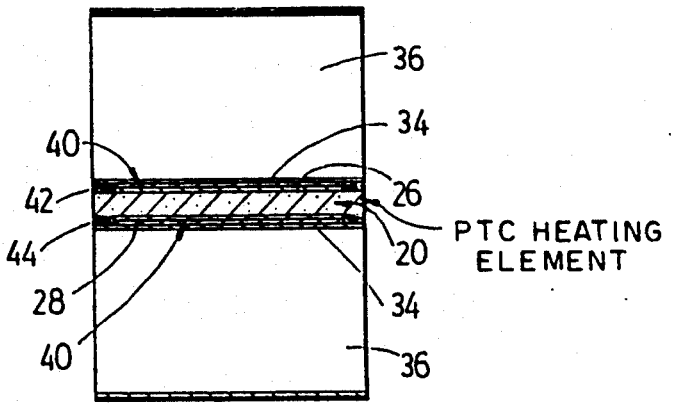
FIG. 3 shows an enlarged sectional view of the portion taken along the line 3—3 as shown in FIG. 1.
Figure 4:
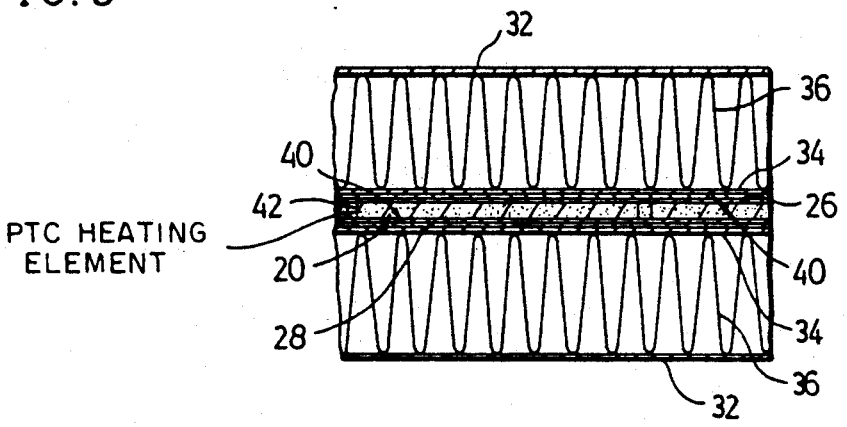

Referring to all drawings provided herein, the PTC heating set 10 of the present invention is shown comprising a plurality of PTCR pieces 20 of rectangular construction, which are arranged in sequence and in a linear manner, and two electrodes 26 and 28 which can be formed by silver or aluminum spraying. Each of the PTCR pieces 20 is provided with two contact surfaces 22 and 24 relative opposite and parallel to each other. Two electrodes 26 and 28 are respectively deposited on the contact surface 22 and 24. Each of the PTCR pieces 20 is sandwiched between the two heat radiating devices 30 made of metal.

The heat radiating device 30 is composed of two long metal battens 32 and 34 and the corrugated metal heat radiating piece 36 sandwiched between the two metal battens 32 and 34. The metal batten 32 is provided at one end thereof an extended tap end 321 for power source.

According to the PTC heating set 10 of the present invention, each of the PTCR pieces 20 is sandwiched between the two heat radiating devices 30. Attached to the outer side surface 342 of the metal batten 34 is a metal thin piece 40 having a surface area smaller than the outer side surface 342. As a result, a rectangular frame portion 344 is formed in the outer side surface 342. The frame portion 344 is coated with an electrically nonconducting adhesive containing material such as silicon gel or an epoxy derivative. Thereafter, each of the PTCR pieces 20 is sandwiched between the upper and the lower metal heat radiating devices 30 in such a manner that the exposed surfaces of the electrodes 26 and 28 are in contact with the metal thin piece 40 and in the meantime are attached intimately to the outer side surface 342 by virtue of the electrically nonconducting adhesive forming the thin layers 42 and 44 as shown in the drawings. In the process of making the PTC heating set 10 of the present invention, the metal heat radiating devices 30 sandwiching therebetween a plurality of linearly arranged PTCR pieces 20 are braced with clamping means before being sent via a conveyer into an oven, in which they are subjected to baking under the temperature ranging from 150 to 200 degrees in Celsius for ten to fifteen minutes so as to cure the adhesive thin layers 42 and 44. The cured adhesive thin layers 42 and 44 are responsible for the intimate association of the metal heat radiating devices 30 with the PTCR pieces 20. Such association permits the heat generated by the PTCR pieces 20 to be absorbed effectively and radiated subsequently to the surroundings by the metal heat radiating devices 30 when the power source tap ends 321 and 341 are supplied with voltage.

It is apparent that PTC heating set 10 of a present invention does not suffer from the thermal fatigue because it is not provided with the component such as biasing means susceptible to thermal fatigue. In addition, a short circuit between the PTCR electrode and the heat radiating device is effectively averted because the contact surfaces of the PTCR electrode and the heat radiating device are bridged by means of nonconducting adhesive. Furthermore, the horizontal surface of the PTCR electrode makes contact with the horizontal outer surface of the heat radiating device via a conducting thin piece, thereby resulting in a reduction in heat impedance of the heat radiating device. In other words, the PTCR heating set 10 of the present invention can generate a greater amount of heat output as a result of a substantial increase in the heat radiating coefficient.

Figure 5:
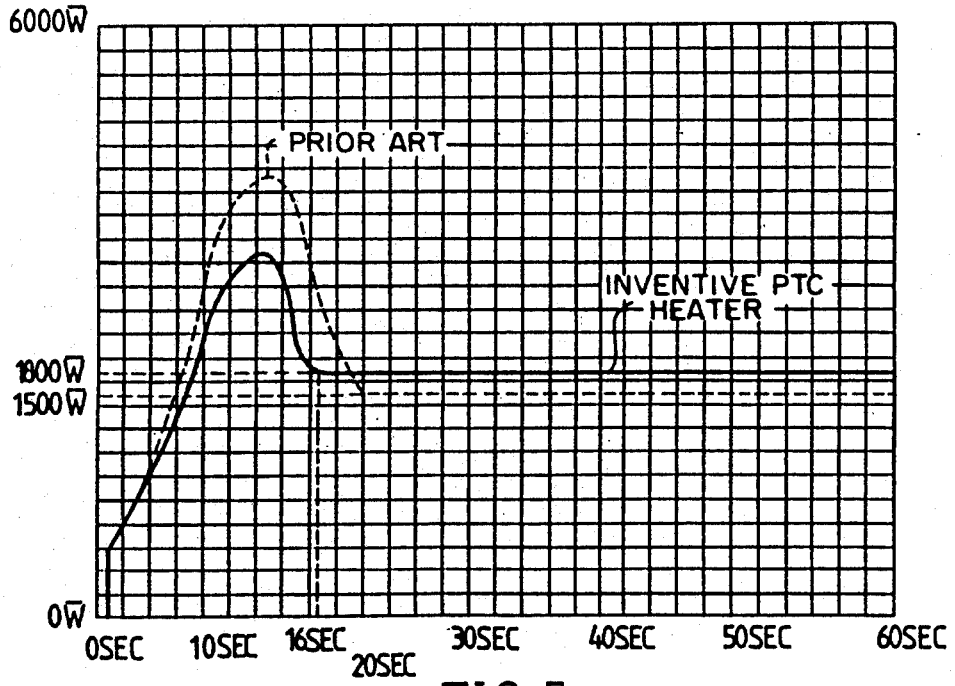
FIG. 5 shows a comparison chart in terms of the power and the time relationships under the identical conditions between the preferred embodiment of the present invention and the prior art PTC heating set having a corrugated PTCR electrode surface.

As shown in FIG. 5, two charts, one in dotted line representing the prior art and the other in solid line representing the present invention, are exhibited to compare the power and the time relationships under the identical conditions between the PTC heating set of the present invention and the prior art PTC heating set having a corrugated electrode surface. The heat radiating device 30 of the PTCR heating set 10 of the present invention is made of aluminum alloy and has the dimensions of 97 mm×10 mm×15.07 mm. There are eight heat radiating devices 30. Each of the sixteen PTCR pieces 20 is made of ceramic material and has the dimensions of 23 mm×15 mm×2.1 mm. Each PTCR piece 20 is provided with aluminum electrodes 26 and 28, which have a thickness of about 20 μm and are located respectively at the two horizontal outer surface opposite to each other. The metal thin piece 40 has a thickness of about 20 μm. The viscosity of the silicon adhesive used in the present invention is 220 poises. The input voltage is 220 watts. The surrounding temperature is 24 degrees in Celsius. The PTC heating set 10 of the present invention is capable of generating a stable heat output of about 1800 watts in 16 seconds, as shown in FIG. 5. On the other hand, the prior art PTC heating set having the identical dimensions with those of the PTCR heating set of the present invention is able to generate only 1500 watts of stable heat output in about 20 seconds, as shown in FIG. 5. It goes without saying that the PTC heating set 10 of the present invention is superior to the prior art PTC heating set.

What I claim is:

1. A heating set having a positive temperature coefficient thermistor heating element (PTCR) comprising a positive temperature coefficient resistor member having opposite substantially horizontal surfaces along with the electrodes adhered correspondingly to said surfaces, a metal heat radiating device having a flat metal surface adjacent to an exposed surface of at least one of said electrodes, and an electrically nonconducting adhesive on a portion of said flat metal surface of said metal heat radiating device bonding the exposed surface of said electrode to the adjacent flat surface of said heat radiating device, said heating set further characterized in that it is provided with an electrically conductive thin piece having a surface area which is disposed in such a manner that it makes direct surface to surface contact with both the flat surface of said heat radiating device other than on said portion provided with said adhesive and the exposed surface of said electrode.

2. A heating set having positive temperature coefficient thermistor heating element according to claim 1, wherein said adhesive is applied respectively to a portion of the flat surface of said heat radiating device and to a portion of the exposed surface of said electrode, with said portion of said heat radiating device and said portion of said electrode making no electrical contact with said conductive thin piece.

3. A positive-temperature-coefficient thermistor heating assembly comprising at least one positive-temperature-coefficient thermistor element;

metal heat radiating devices each having a flat metal surface facing toward said positive-temperature-coefficient thermistor element and with said heat radiating devices attached on opposite sides of said at least one positive-temperature-coefficient thermistor element at said flat metal surfaces;

said positive-temperature-coefficient thermistor element including metallic sprayed surface electrodes on opposite sides thereof, a contact surface bordering around each of said metallic sprayed surface electrodes;

said flat metal surfaces of said heat radiating devices each having a border portion for receiving said contact surface around said flat metal surface;

an electrically conductive thin piece having surface areas on both sides fitted within said border potion around said flat metal surface with said surface area on one side in direct electrical contact with said flat metal surface of one of said heat radiating devices and with said surface area on the other side in direct surface to surface electrical contact with a said metallic sprayed surface electrode interiorly of said bordering contact surface.

an electrically insulative adhesive on said border portion of said flat metal surface of said heat radiating device adhesively connecting said border portion with said contact surface.

* * * * *